United States Patent [19]

Lefebvre

[11] 4,296,876

[45] Oct. 27, 1981

[54] GARMENT CHECKING BAG

[75] Inventor: Henry R. Lefebvre, Laguna Hills, Calif.

[73] Assignee: Sun Aired Bag Co., Inc., Sunland, Calif.

[21] Appl. No.: 25,197

[22] Filed: Mar. 29, 1979

[51] Int. Cl.[3] ..... A47J 51/08; A47J 51/14

[52] U.S. Cl. ..... 223/91

[58] Field of Search ..... 223/85, 96, 91, 92, 223/93, 95, 97, 88; D6/247; 206/284, 286, 278

[56] References Cited

U.S. PATENT DOCUMENTS

| | | | |
|---|---|---|---|
| 862,706 | 8/1907 | Brenizer | 223/96 |
| 1,540,363 | 6/1925 | Reid | 223/88 |
| 1,613,354 | 1/1927 | Mathes | 223/96 X |
| 2,556,461 | 6/1951 | Baron | 223/85 X |
| 2,581,675 | 1/1952 | Lefebvre | 223/85 |
| 3,463,324 | 8/1969 | Schaefer | 223/85 X |
| 3,537,625 | 11/1970 | Nuttall | 223/85 |

FOREIGN PATENT DOCUMENTS

| | | | |
|---|---|---|---|
| 73855 | 6/1970 | Fed. Rep. of Germany | 223/85 |
| 1235616 | 6/1971 | United Kingdom | 223/85 |

*Primary Examiner*—Werner H. Schroeder
*Assistant Examiner*—Andrew M. Falik
*Attorney, Agent, or Firm*—Kendrick, Netter & Bennett

[57] ABSTRACT

An improved garment checking bag includes a horizontal bar with a hook projecting upwardly from an intermediate portion of the bar, a foraminous bag attached to and hanging from the bar and a horizontal hanger rod attached to the bar. The hook is part of a unitary hook and shaft that extends through an opening in the horizontal bar and terminates in a flange that precludes removal and inhibits rotation of the shaft in the opening. The horizontal bar is a cylindrical member with an opening in each end; the horizontal rod has a bent portion at each end, that rotatably engages one of those openings.

3 Claims, 3 Drawing Figures

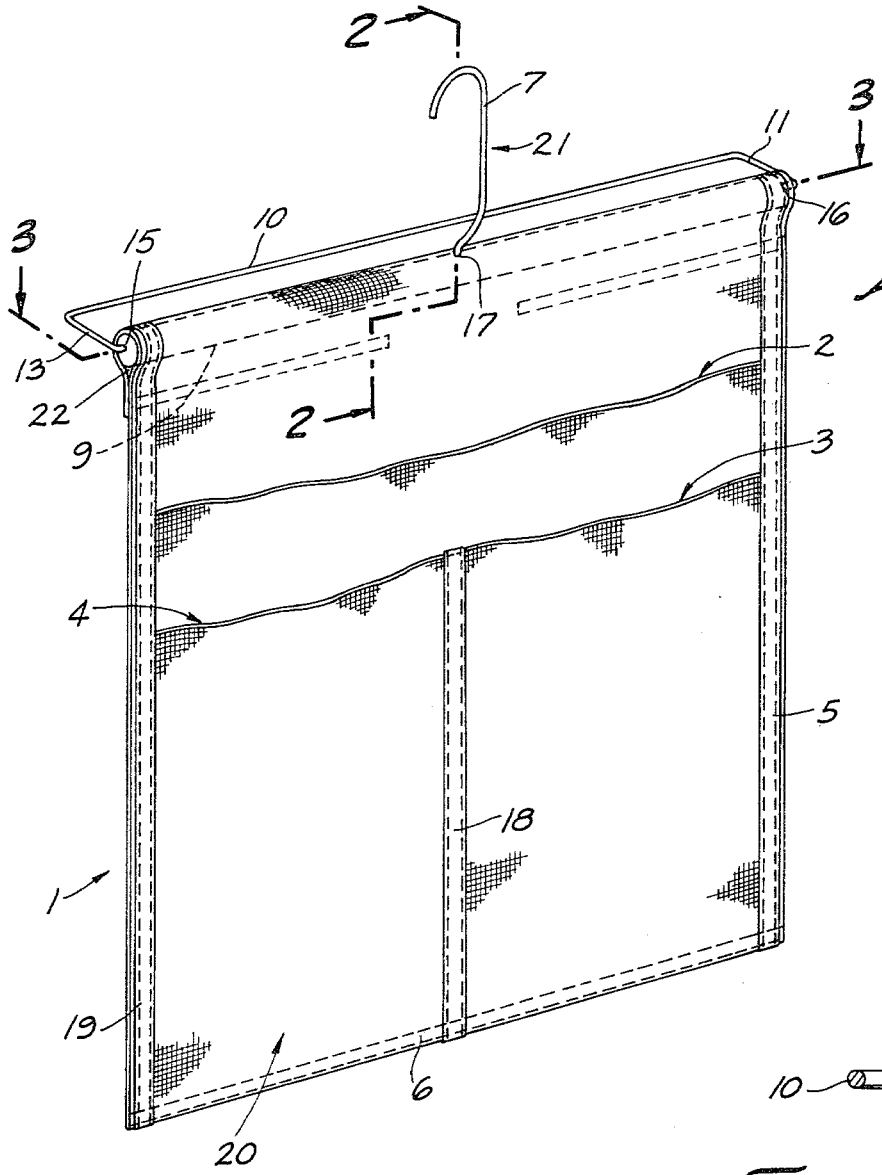
FIG. 1.
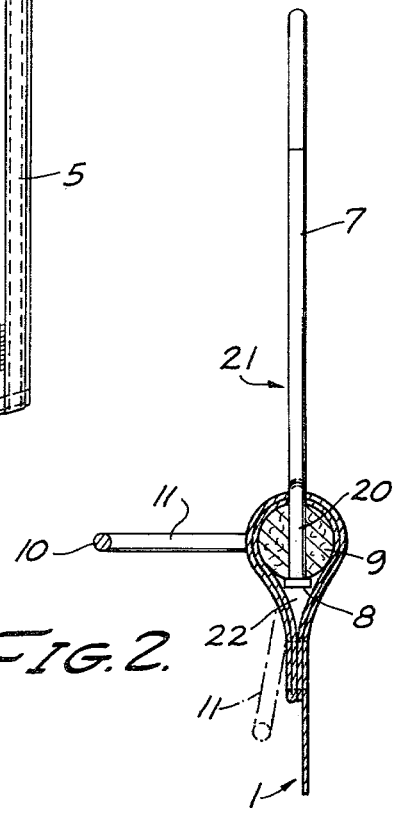
FIG. 2.
FIG. 3.
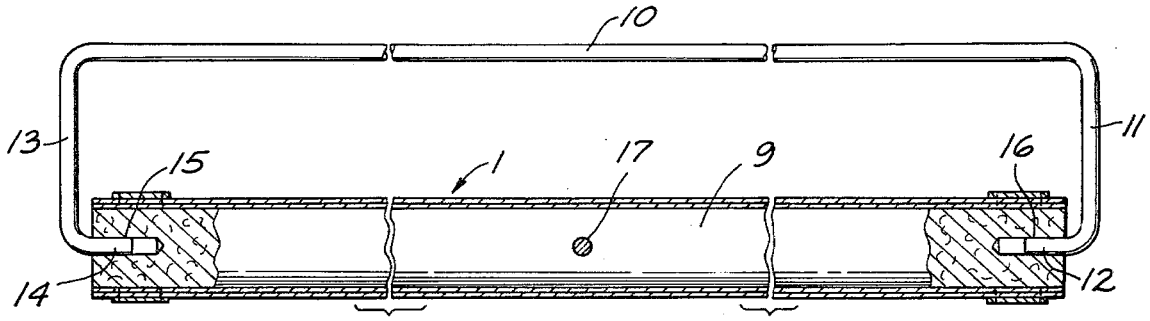

GARMENT CHECKING BAG

This invention relates to new and useful improvements in garment checking bags of the kind disclosed in U.S. Pat. No. 2,581,675, which issued Jan. 8, 1952 under the title "GARMENT CHECKING BAG". The drawings and the entire disclosure of that patent are hereby incorporated by reference in this disclosure.

The checking bag disclosed in U.S. Pat. No. 2,581,675 has enjoyed commercial success, but has some drawbacks. For example, the hook member 16 in FIG. 2 of the drawings in that patent tends to rotate out of the plane of the bag, and the horizontal rod 17 in the same drawing, which is fixedly attached to horizontal bar 15, tends to engage other bags and garments contiguous to the side of the bag from which the rod projects. Both of these drawbacks limit the number of bags that can be stored on a rack.

This invention overcomes these and other drawbacks. Specifically, in the improved garment bag of this invention, the horizontal bar is a cylindrical member rather than the square member disclosed in U.S. Pat. No. 2,581,675. This facilitates constructing the bag. This cylindrical horizontal bar has an opening in each end to rotatably engage the improved horizontal rod that is yet another improvement in the bag. The improved horizontal rod is a single rod means having bent portions at each end that engage rotatably in the openings at each end of the cylindrical horizontal bar.

In the preferred embodiment of the improved bag, the bent portions at each end of the horizontal rod have portions that are formed at about right angles to the bent portions and are parallel to and project toward the center of the rod means. These tip portions engage rotatably in the openings at each end of the horizontal bar means, thus holding the rod means parallel to and rotatable about the axis of the cylindrical horizontal bar means.

The hook means in the improved garment bag is also improved in structure. In particular, the hook means is now a unitary hook and shaft means. The shaft means entends through an opening in the horizontal bar and terminates in flange means that precludes removal of the shaft from the opening, and minimizes the tendency of the shaft to rotate out of the plane of the bag. This facilitates hanging a large number of improved garment bags side-by-side on a rack.

The improvements in the garment checking bag are better understood by reference to the enclosed drawings in which:

FIG. 1 is a perspective view of the improved checking bag;

FIG. 2 is a vertical sectional view of the hook and shaft means in the improved bag taken on line 2—2 of FIG. 1; and, FIG. 3 is a sectional view taken on line 3—3 of FIG. 1, and shows the improved horizontal rod means rotatably engaged in the ends of the horizontal cylindrical bar means of the improved bag.

Referring now to FIG. 1 in detail, improved checking bag 1 includes a bag portion having a large pocket 2 and smaller pockets 3 and 4 secured together by seams 5, 6, 18 and 19. The construction and function of these pockets is the same as disclosed in U.S. Pat. No. 2,581,675.

Improvements in the checking bag include the cylindrical, horizontal bar means 9 in sleeve portion 22 at the top of the bag. Bar means 9 has an opening 17 passing transversely through an intermediate portion thereof. In that opening is new unitary hook and shaft means 21, which fits snugly within opening 17, thus minimizing the tendency of the hook to rotate out of the plane of the bag. Bar means 9 has openings 15 and 16 at its ends for rotatably receiving the improved horizontal bar 10 of the improved bag. The unitary hook and shaft means 21 includes a hook means 7 at its upper end and a shaft means 20 that passes through opening 17 and terminates in flange means 8. Flange means 8 precludes removal of the hook and shaft means from opening 17. This facilitates keeping a plurality of the checking bags neatly hung on a single rack and minimizes the amount of space each bag occupies.

As best seen in FIG. 3, horizontal rod means 10 has bent end portions 11 and 13 formed at approximately right angles to horizontal rod means 10. End portions 11 and 13 terminate in bent tip portions 12 and 14, which are formed at approximately right angles to end portions 11 and 13, respectively, and which project toward the center of rod means 10. Tip portions 12 and 14 rotatably engage openings 15 and 16, respectively, of horizontal bar means 9, leaving rod means 10 free to rotate about (and parallel to) the longitudinal axis of bar means 9.

As with the garment checking bag disclosed in U.S. Pat. No. 2,581,675, the improved bag means includes a bag portion 20 suspended from horizontal bar means 9 that is made of foraminous material to permit free circulation of air through the bag and over articles placed therein. Because the foraminous material is mesh, the contents of the bag can be seen without removing them from the bag.

Because the improved checking bag includes a hook member that tends to remain in the plane of the bag, and a horizontal clothes rod that can rotate to a position contiguous with the bag, many more bags with these improvements can be stored easily in a given space. In sum, the improvements greatly increase the utility of the bags.

What is claimed is:

1. A garment bag structure including horizontal bar means, hook means projecting upwardly from an opening in an intermediate portion of said horizontal bar means, a foraminous bag attached to and depending from said bar means, and a horizontal rod means attached to said bar means, said horizontal bar means comprising a cylindrical member having an opening in each end thereof, and said horizontal rod means having bent portions at each end thereof that rotatably engage the openings at the ends of said horizontal bar means, said horizontal rod means being rotatable to a position contiguous with said bag, whereby said structure occupies a relatively narrow space.

2. The bag of claim 1 wherein said bent end portions are at approximately right angles to said horizontal rods means, and include tip portions that are parallel to the rod means and project toward the center thereof.

3. The garment bag structure of claims 1 or 2 further comprising wherein said hook means includes hook and shaft means, said shaft means extending through and fitting snugly within an opening in said horizontal bar means at said intermediate portion and terminating in flange means that precludes removal of such shaft means from said opening, said shaft means having the capacity to resist rotation in said opening.

* * * * *